US006861996B2

(12) United States Patent
Jeong

(10) Patent No.: US 6,861,996 B2
(45) Date of Patent: Mar. 1, 2005

(54) WAVEGUIDE SLOT ANTENNA AND MANUFACTURING METHOD THEREOF

(75) Inventor: Kyeong Hwan Jeong, Namyangju-si (KR)

(73) Assignee: Microface Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/469,764

(22) PCT Filed: Mar. 20, 2002

(86) PCT No.: PCT/KR02/00468

§ 371 (c)(1),
(2), (4) Date: Sep. 4, 2003

(87) PCT Pub. No.: WO02/078125

PCT Pub. Date: Oct. 3, 2002

(65) Prior Publication Data

US 2004/0080463 A1 Apr. 29, 2004

(30) Foreign Application Priority Data

Mar. 21, 2001 (KR) ..... 2001-14477
Aug. 20, 2001 (KR) ..... 2001-49929
Mar. 13, 2002 (KR) ..... 2002-13581

(51) Int. Cl.[7] ..... H01Q 13/10
(52) U.S. Cl. ..... 343/770; 343/771; 29/600
(58) Field of Search ..... 343/767, 770, 343/771; 29/600

(56) References Cited

U.S. PATENT DOCUMENTS 4,916,458 A * 4/1990 Goto ..... 343/771
5,327,150 A * 7/1994 Cherrette ..... 343/771
5,541,612 A * 7/1996 Josefsson ..... 343/771
5,579,019 A * 11/1996 Uematsu et al. ..... 343/771
5,831,583 A * 11/1998 Lagerstedt et al. ..... 343/771
6,127,985 A * 10/2000 Guler ..... 343/771
6,285,335 B1 * 9/2001 Snygg et al. ..... 343/770
6,535,173 B2 * 3/2003 Ou ..... 343/770
6,720,931 B1 * 4/2004 Michisaka et al. ..... 343/754

FOREIGN PATENT DOCUMENTS

KR 96-15570 B1 11/1996

OTHER PUBLICATIONS

Sakakibara, K. IEE Proc.–Microw. Antennas Propag. vol. 144, No. 6, Dec. 1997.

Lertwiriyaprap, Titipong. IEEE Antennas and Propagations Society International Symposium. Jul. 2000.

* cited by examiner

*Primary Examiner*—Tan Ho
(74) *Attorney, Agent, or Firm*—Birch, Stewart, Kolasch & Birch, LLP

(57) ABSTRACT

This invention relates to a waveguide slot antenna and a method of manufacturing. More particularly, the invention relates to a waveguide slot antenna designed in a multi-layer structure in the form of waveguide slot with the characteristics of a sharp directivity and high gain. Also, the invention relates to an antenna manufacturing method that provides a conductive characteristic to dielectric synthetic resin by thinly coating the synthetic resin with a conductive metal after injection molding.

22 Claims, 9 Drawing Sheets

WAVEGUIDE SLOT ANTENNA AND MANUFACTURING METHOD THEREOF

This application is the national phase under 35 U.S.C. § 371 of PCT International Application No. PCT/KR02/00468 which has an International filing date of Mar. 20, 2002, which designated the United States of America.

BACKGROUND OF THE INVENTION

This invention relates to a waveguide slot antenna and a method of manufacturing thereof. More particularly, the invention relates to a waveguide slot antenna designed as a multi-layer structure in the form of waveguide slot with the characteristics of a sharp directivity and high gain. Also, the invention relates to an antenna manufacturing method that provides a conductive characteristic to dielectric synthetic resin by thinly coating the synthetic resin with a conductive metal after injection molding.

In general, a cross section of waveguides has many different shapes. According to the shape of a waveguide, it is classified as a circular waveguide, rectangular waveguide, and elliptical waveguide. A waveguide is a kind of a metal pipe that acts as a high frequency pass filter. The guide mode has a fixed cut off wavelength. This basic mode is determined by the length of a waveguide. The waveguide is a type of a transmission line for transmitting a high frequency electronic wave above the microwave level. The waveguide is made of a conductive substance such as copper and an electromagnetic wave can be transmitted through the guide. The waveguide acts as a high frequency filter in order to allow the transmission of a wavelength range below the cut off wavelength.

The wavelength of a wave which travels along the axis of a waveguide is called a guide wavelength. This guide wavelength is longer than an exciter wavelength. The transmission line for low frequency is usually a pair of copper lines. For high frequency, there are increasingly more conductive loss due to surface effect and dielectric loss due to the surrounding dielectric bodies. However, for the transmission of electromagnetic wave through a waveguide, there is a small amount of loss due to the reflection from the guide walls inside of the waveguide.

The basic mode of a waveguide as mentioned above is determined by its size. The above waveguide has a small amount of damping compared to a parallel 2 line type or coaxial cable and therefore, it can be used for a microwave transmission line for a high power output purpose.

A micro strip patch array antenna using a dielectric substrate has now been commercialized after the development of a dielectric material that results a little loss even in high frequency.

However, the dielectric loss is inevitable due to the characteristics of the dielectric substrate. Also, there are many difficulties involved in the manufacturing of a high gain antenna due to the resistance loss of a conductor and the high cost of dielectric substrates impose a limitation to commercialization.

A waveguide slot antenna which does not utilize a dielectric substance but has a number of holes in the shape of a slot. The history of the waveguide slot antenna goes back much further than a flat antenna but due to the difficulties involving its weight, size and precision for manufacturing, the flat antenna made of a dielectric substance is in much wider use.

Especially, it is much more difficult to design a waveguide slot antenna than a flat antenna made of a dielectric substance. It is more likely to show the Grating Rove characteristic and a high gain antenna is very hard to manufacture.

SUMMARY OF THE INVENTION

The present invention is designed to overcome the above problems of prior art. The object of the invention is to provide a waveguide slot antenna which has the advantages of having a high gain compared to a single level waveguide due to the utilization of multi-layer structure, a superior bandwidth compared to a flat antenna of the same size made of a dielectric substance, a superior reception gain and a superior reception rate.

Another object of the present invention is to provide a competitive waveguide slot antenna which is light, mass manufacturable and has a low manufacturing cost by forming an upper, mid and lower layer conductive panel of a waveguide using synthetic resin.

A waveguide slot antenna, comprises: a lower layer conductive panel which further comprising a feeder line of a fixed length and width with an open face for gathering frequency signals towards the center in order to output them, a first waveguide which is connected to said feeder line in order to act as a transmission line of the frequency signals, and a radiation waveguide which is connected to one side of said first waveguide for receiving the frequency signals; a mid layer conductive panel which is piled on the upper section of said lower layer conductive panel and has radiation holes which penetrate from the upper part to lower part at fixed intervals, and further comprises a second wave guide and a second feeder line where said radiation holes and said lower layer conductive panel are connected at the lower face; and an upper layer conductive panel which are piled on the upper section of said mid layer conductive panel and has protrusions at fixed intervals, a plurality of slots located at one side of said protrusion and penetrate from the upper to lower section, and a plurality of guides in the shape a cavity at fixed intervals on the lower face.

The upper, mid and lower layer conductive panel of the waveguide according to the present invention are made of synthetic resin and are thinly coated with Ni, Cu, $H_2SO_4$, EX, $5H_2O$, $H_3BO3$, $NISO_4$, $6H_2O$.

Also, the upper, mid and lower layer conductive panels of the waveguide according to the present invention are made of a metallic substance.

Also, the one side of radiation waveguide of the upper layer conductive panel of the waveguide according to the present invention comprises multi-layer protrusions in order to transfer frequency signals from radiation holes of mid layer conductive panel to the first waveguide and second waveguide without a loss.

Also, the plurality of slots on the upper layer conductive panel according to the present invention form 4 different groups and are focused into one guide in the shape of a cavity. The plurality of slots are piled onto each other in order to transfer the focused frequency signals to the radiation waveguide of the upper layer conductive panel via the radiation holes of the mid layer conductive panel.

Also, the mid layer conductive panel of the waveguide according to the present invention is formed so that the plurality of radiation holes, and the second waveguide and second feeder line are connected to each other in order to allow an active frequency signals reception.

Also, according to the present invention, the upper face of the low layer conductive panels of the waveguide, the feeder line that outputs the focused satellite frequency signals, the first waveguide which acts as a transmission line in connection with said feeder line, and radiation waveguide that receives the frequency in connection with said first waveguide are thinly coated with a metallic substance.

Also, according to the present invention, the upper face of the mid face of the low layer conductive panels of the waveguide, a plurality of radiation holes formed at said upper face, and the second waveguide and second feeder line are thinly coated with a metallic substance in order to receive the satellite frequency.

Also, the one side of radiation waveguide of the upper layer conductive panel of the waveguide according to the present invention comprises multi-layer protrusions in order to transfer the frequency signals from the radiation holes of the mid layer conductive panel to the first waveguide and second waveguide without a loss.

Also, the plurality of slots on the upper layer conductive panel according to the present invention form 4 different groups and are focused into one guide in the shape of a cavity. The plurality of slots are piled onto each other in order to transfer the focused frequency signals to the radiation waveguide of the upper layer conductive panel via the radiation holes of mid layer conductive panel.

Also, the mid layer conductive panel of the waveguide according to the present invention is formed so that the plurality of radiation holes, and the second waveguide and second feeder line are connected to each other in order to allow an active frequency signals reception.

Also, according to the present invention, the second waveguide formed at the mid layer conductive panel, the second feeder line, the first waveguide formed at the lower layer conductive panel, radiation waveguide and the multi-layer protrusion are symmetrically formed.

Also, according to the present invention, on the one side of the mid layer conductive panel has a hooking jaw in order to pile onto the upper section of the lower layer conductive panel.

The manufacturing method of a waveguide slot antenna according to the present invention comprises the steps of: a molding step for molding the body of the antenna by pouring synthetic resin into a molding fixture; a molding checking step for checking the molding for any deformation, incomplete part and addition of foreign substances on the external body of the antenna; a match checking step for checking the matching for analyzing the materials and chemical composition for the antenna body, a first drying step for drying the antenna body by putting the antenna in a drier for a fixed amount of time; an etching step for etching the surface of the antenna in order to improve the degree of crystallization of the dry hardened antenna; a second drying step for drying the surface of the etched antenna after a cleaning step; a deposition step for depositing (Cu, $H_2SO_4$, $CuSO_4$, $5H_2O$, $H_3BO_3$, SB-75, SB-70M, $NISO_4$, EX, $6H_2O$, G1, G2, Chrome) using a electrical coating after an initial coating with the chemicals (Ni(YS100A, YS101B, YS102C)) in order to be able to receive the frequency on the surface of the antenna body using a non-electrolyte coating; and a third drying step for drying the body of the antenna in a dryer after the metallic substance has been deposited.

Also, the deposition step according to the present invention further includes a step of adding a metal substance (Fe) which acts as a catalyst in the coating liquid deposited on the body of the antenna.

Also, the deposition step according to the present invention further includes a step of depositing a coating layer on the plurality of radiation holes, the second waveguide and the second feeder line in order to allow an active frequency signals reception by the mid layer conductive panel.

Also, the deposition step according to the present invention further includes a step of depositing a coating layer on the guides in the shape a cavity on the upper layer conductive panel and the radiation holes on the mid layer conductive panel in order to act as connection line for frequency signals.

Also, the present invention further includes a step of checking the surface adherence of the waveguide slot antenna using a microscope and fixing jig after finishing the third drying step.

Also, the metal thin coating of the antenna body according to the present invention utilizes a non-electrolyte coating of a metallic substance.

Also, the deposition of metallic conductive substance on the antenna body according to the present invention utilizes a spray gun.

Also, the coating liquid deposited on the antenna body according to the present invention further includes metallic substances such as Fe, Ni, and P.

BRIEF DESCRIPTION OF THE DRAWINGS

FIG. 7 shows a graph which plots the radiation patterns of the antenna which utilizes metallic coating according to the results of the experiment.

FIG. 9 shows a graph which plots the radiation patterns of the antenna which utilizes metallic coating according to the results of the experiment.

DESCRIPTION OF THE NUMERIC ON THE MAIN PARTS OF THE DRAWINGS

100: Antenna
110: Upper Layer Conductive Panel
111: Protruding Section
112: Slot
113: A Guide in the Shape of A Cavity
114: Hooking Jaw
115, 125, 135: Thin Coating
120: Mid Layer Conductive Panel
121: Radiation Hole
122: Second Waveguide
123: Second Feeder Line
124: Second Distribution Line
130: Lower Layer Conductive Panel
131: Radiation Waveguide
132: First Waveguide
133: First Feeder Line
134: Multi-Level Protruding Section

DETAILED DESCRIPTION OF THE EMBODIMENTS

Hereinafter, preferred embodiments of the present invention will be described in detail with reference to the accompanying drawings.

Figure 1:
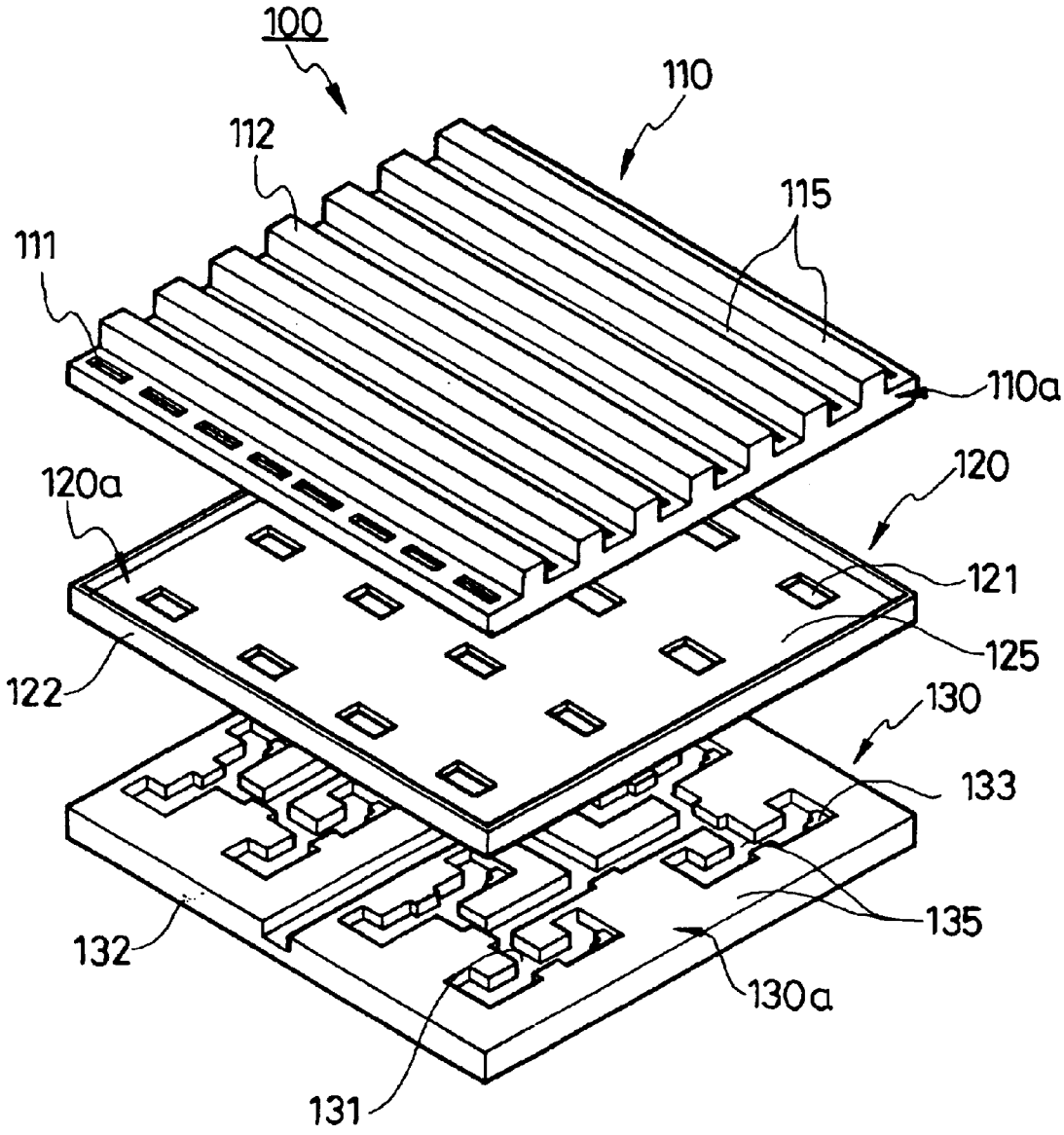
FIG. 1 is an exploded diagram which shows the construction of the waveguide slot antenna according to the present invention.

FIG. 1 is an exploded diagram which shows the construction of the waveguide slot antenna according to the present invention. FIG. 2*b* shows the upper layer conductive panel according to the present invention as shown in FIG. 1. FIG. 2*b* shows the front view of the upper layer conductive panel according to the present invention as shown in FIG. 1. FIG. 2*c* shows a cross section of the upper layer conductive panel according to the present invention as shown in FIG. 1

Figure 3A:
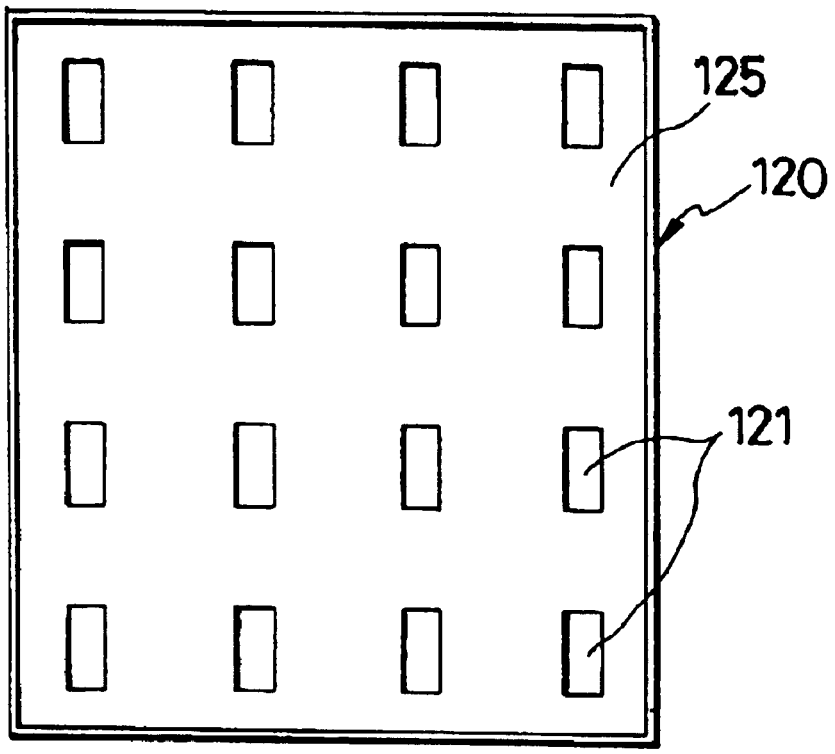
FIG. 3*a* shows the plane view of the mid layer conductive panel according to the present invention as shown in FIG. 1.
Figure 3B:
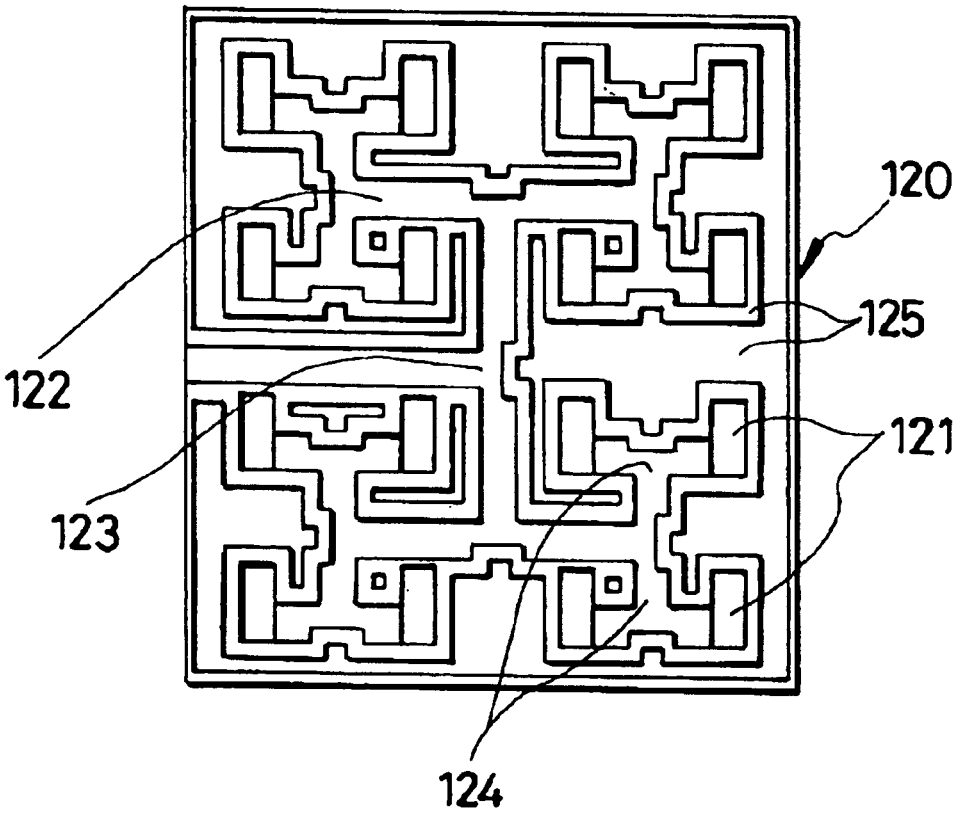
FIG. 3*b* shows the front view of the mid layer conductive panel according to the present invention as shown in FIG. 1.
Figure 3C:
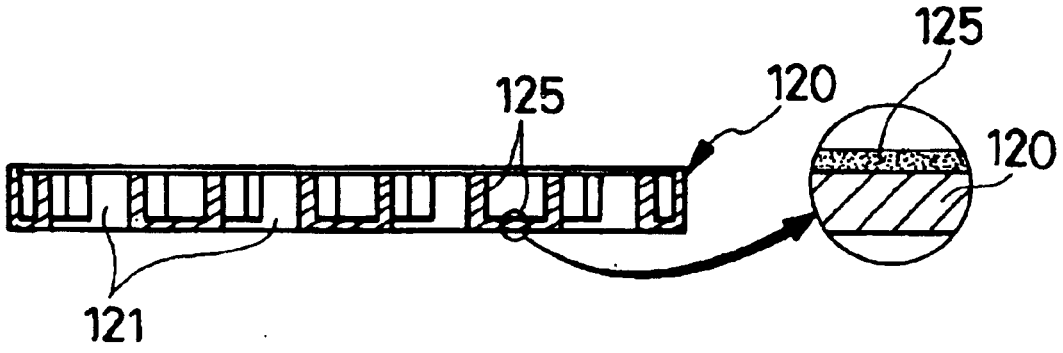
FIG. 3*c* shows a cross section of the mid layer conductive panel according to the present invention as shown in FIG. 1

FIG. 3*a* shows the plane view of the mid layer conductive panel according to the present invention as shown in FIG. 1. FIG. 3*b* shows the front view of the mid layer conductive panel according to the present invention as shown in FIG. 1. FIG. 3*c* shows a cross section of the mid layer conductive panel according to the present invention as shown in FIG. 1

Figure 4A:
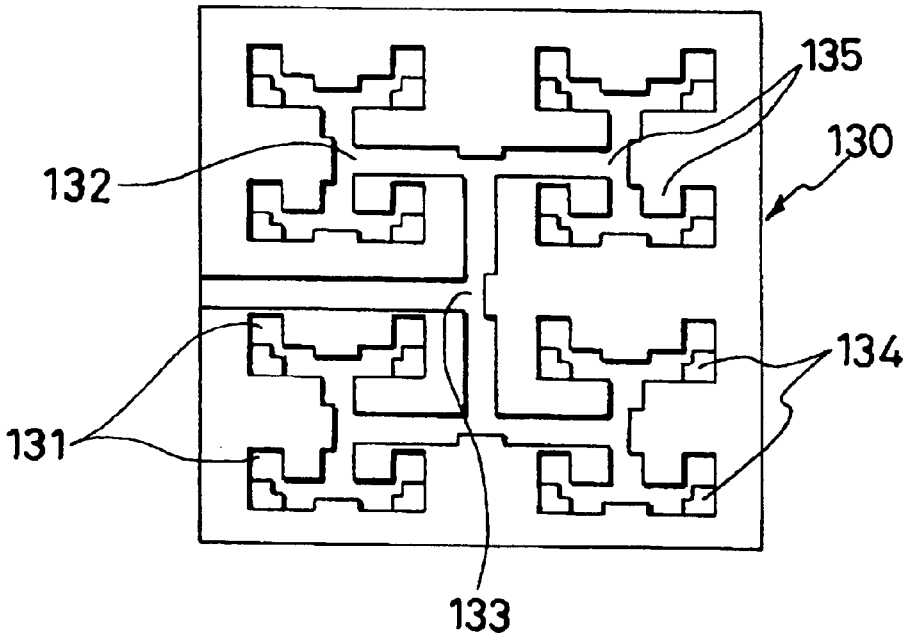
FIG. 4*a* shows the plane view of the lower layer conductive panel according to the present invention as shown in FIG. 1.

FIG. 4*a* shows the plane view of the lower layer conductive panel according to the present invention as shown in FIG. 1. FIG. 4*a* shows the front view of the lower layer conductive panel according to the present invention as shown in FIG. 1. FIG. 4*c* shows a cross section of the lower layer conductive panel according to the present invention as shown in FIG. 1

As shown in FIG. 1, the waveguide slot antenna according to the present invention comprises a lower layer conductive panel 130, mid layer conductive panel 120 and upper layer conductive panel 110. These lower, mid and upper layer conductive panels are piled onto each other.

Figure 2A:
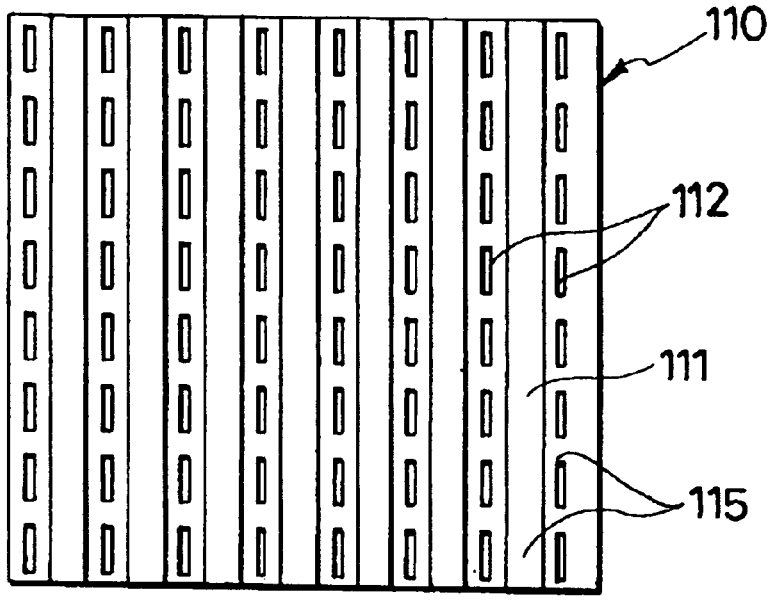
FIG. 2*a* shows the upper layer conductive panel according to the present invention as shown in FIG. 1.
Figure 2B:
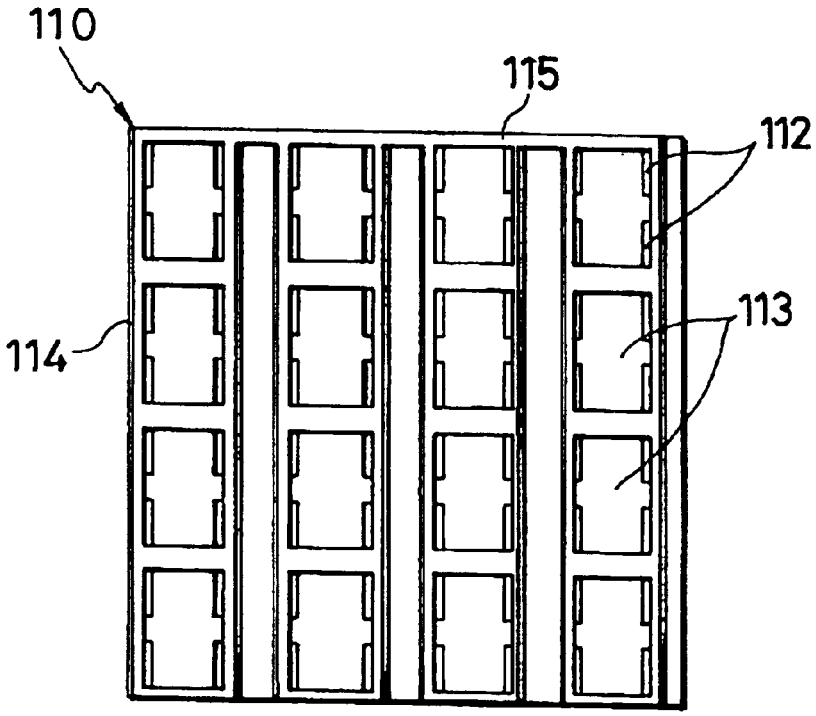
FIG. 2*b* shows the front view of the upper layer conductive panel according to the present invention as shown in FIG. 1.
Figure 2C:
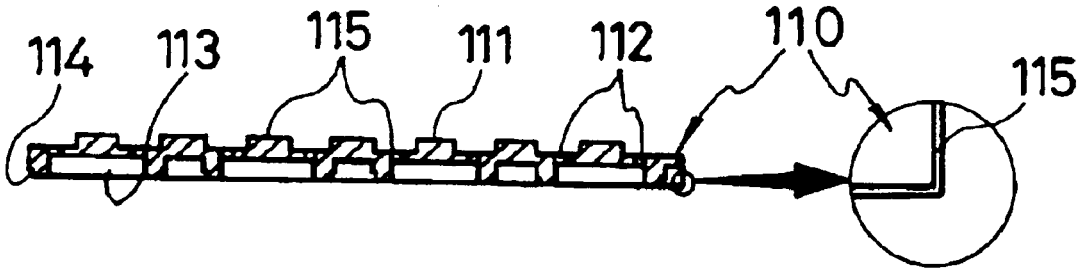
FIG. 2*c* shows a cross section of the upper layer conductive panel according to the present invention as shown in FIG. 1

As shown in FIG. 2*a* to FIG. 2*c*, a first feeder line 133 which has one open face and acts as a frequency signal path with a fixed width at the center formed on the lower face of the lower layer conductive panel 130. A first waveguide 132 is formed in connection with the first feeder line 133 in order to transmit the frequency signals. A radiation waveguide 131 is formed at one side of the first waveguide 132 in order to receive the frequency signals.

Also, protruding sections 134 are formed in order to change the signal direction within the radiation waveguide 131 of the lower layer conductive panel. The protruding sections 134 are formed as a single body in order to minimize the loss.

As shown in FIG. 3*a* to FIG. 3*c*, the mid layer conductive panel 120 is piled on top of the lower layer conductive panel 130. The radiation holes on the upper section penetrate from top to bottom and are formed at fixed intervals.

On the mid layer conductive panel 120 of the waveguide, the plurality of radiation holes 121, and the second waveguide, the second feeder line 122 and the second distribution line are connected to each other in order to allow an active frequency signals transmission through the upper layer conductive panel 110.

Figure 4B:
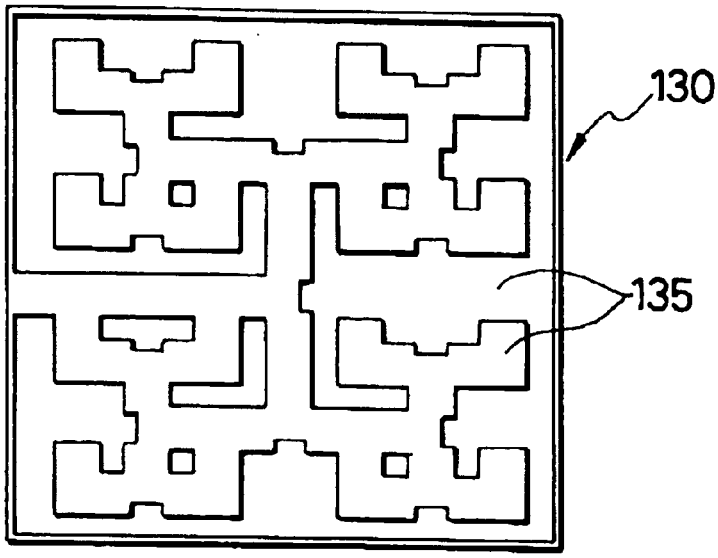
FIG. 4*b* shows the front view of the lower layer conductive panel according to the present invention as shown in FIG. 1.
Figure 4C:
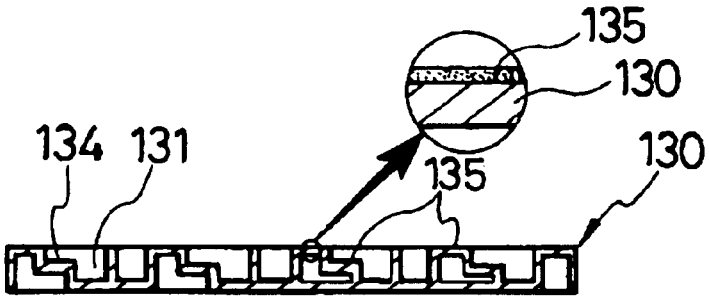
FIG. 4*c* shows a cross section of the lower layer conductive panel according to the present invention as shown in FIG. 1

As shown in FIG. 4*a* to FIG. 4*c*, a protruding section 111 are formed at fixed intervals on the upper layer conductive panel 110. Slots 112 which penetrate from top to bottom at fixed intervals are formed at one side of the protruding section 111 and at lower face forms a guide 113 in the shape of a cavity.

Also, a hooking jaw 114 is formed on the upper layer conductive panel 110 in order to pile onto the lower layer conductive panel 120.

The lower layer conductive panel 130, mid layer conductive panel 120 and upper layer conductive panel 110, which are piled onto each other like the metal waveguide slot antenna, are made of synthetic resin. On the outer faces of the lower layer conductive panel 130, mid layer conductive panel 120 and upper layer conductive panel 110 form a thin metal coating layer (Ni, Cu, $H_2SO_4$, EX, $5H_2O$, $H_3BO_3$, $NISO_4$, $6H_2O$) in order to receive frequency signals.

The function of the multi structural waveguide slot antenna according to the present invention are as follows.

External frequency signals are applied through the slots 112 of the upper layer conductive panel 110. The applied frequency signals are focused to the guide 113 in the shape of a cavity and are transferred to the radiation holes 121 of the mid layer conductive panel 120 and the radiation waveguide 131 of the lower layer conductive panel 130. The signal direction of the transferred frequency signals is changed by the multi-step protruding section 134 formed inside of the radiation waveguide 131 of the lower layer conductive panel 130. The change signals transferred to the second waveguide 122 which is formed at one side of the mid layer conductive panel 120 and the first waveguide 132 of the lower layer conductive panel 130.

The principle of forming a closed guide where a frequency wave travels is as follows. The lower layer conductive panel 130, mid layer conductive panel 120 and upper layer conductive panel 110 are piled onto each other. The second and first waveguides 122, 132 are formed when the second waveguide 122 of the mid layer conductive panel 120 and the first waveguide 132 of the lower layer conductive panel 130 are closed. The second and first waveguides 122, 132 formed as such become a loss-free transmission line.

As shown above, the second and first waveguides 122, 132 are designed as a multi-layer piled structure which is joined by a bolt and nut. As a result, a flat type small antenna can easily be manufactured and a high gain can be obtained by utilizing the internal space of the multi-layer structure.

The waveguide slot antenna 100 according to the present invention is superior in the bandwidth, signal transmission and reception gain in comparison to a flat type antenna that uses dielectric material.

Figure 5:
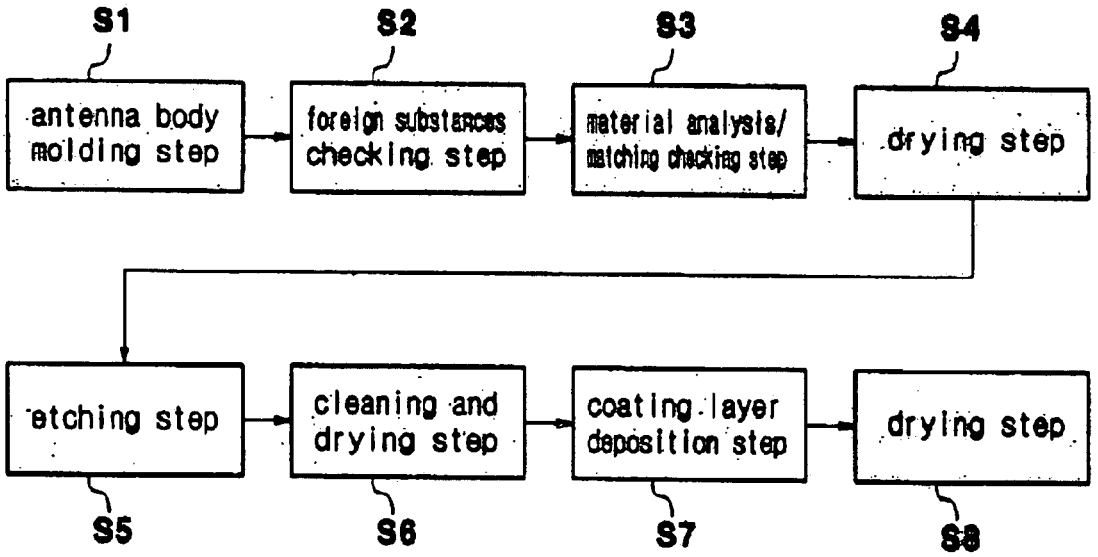
FIG. 5 is a block diagram which shows the manufacturing steps of the antenna which utilizes metallic coating according to the present invention.

FIG. 5 is a block diagram which shows the manufacturing steps of the antenna which utilizes metallic coating according to the present invention.

Figure 6:
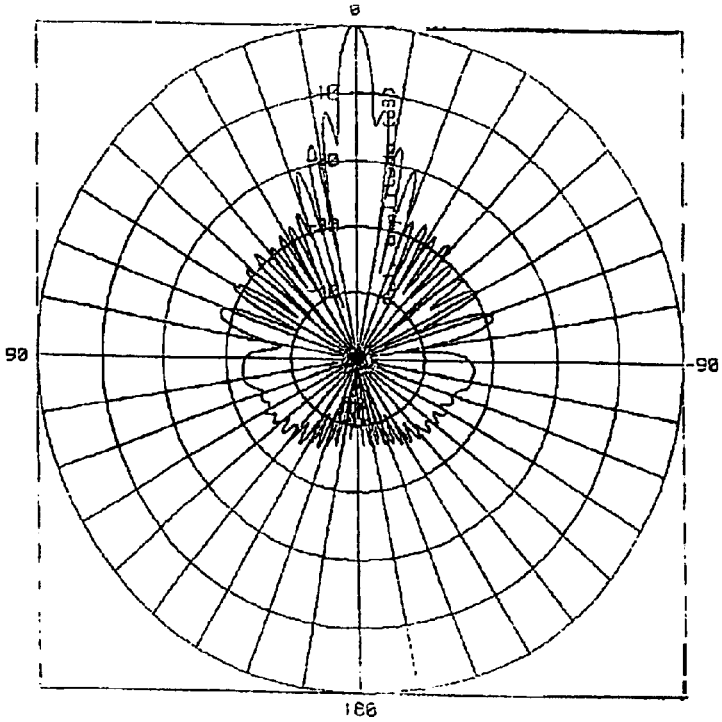
FIG. 6 shows a graph which plots the radiation patterns of the antenna which utilizes metallic coating according to the results of the experiment.

FIG. 6 shows a graph which plots the radiation patterns of the antenna which utilizes metallic coating according to the results of the experiment.

FIG. 7 shows a graph which plots the radiation patterns of the antenna which utilizes metallic coating according to the results of the experiment.

Figure 8:
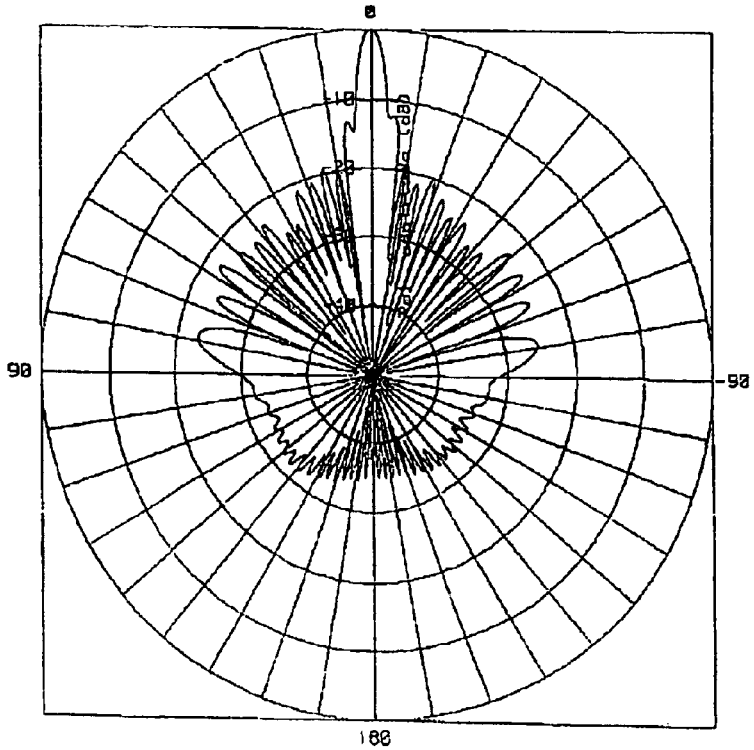
FIG. 8 shows a graph which plots the radiation patterns of the antenna which utilizes metallic coating according to the results of the experiment.

FIG. 8 shows a graph which plots the radiation patterns of the antenna which utilizes metallic coating according to the results of the experiment.

FIG. 9 shows a graph which plots the radiation patterns of the antenna which utilizes metallic coating according to the results of the experiment.

Figure 10:
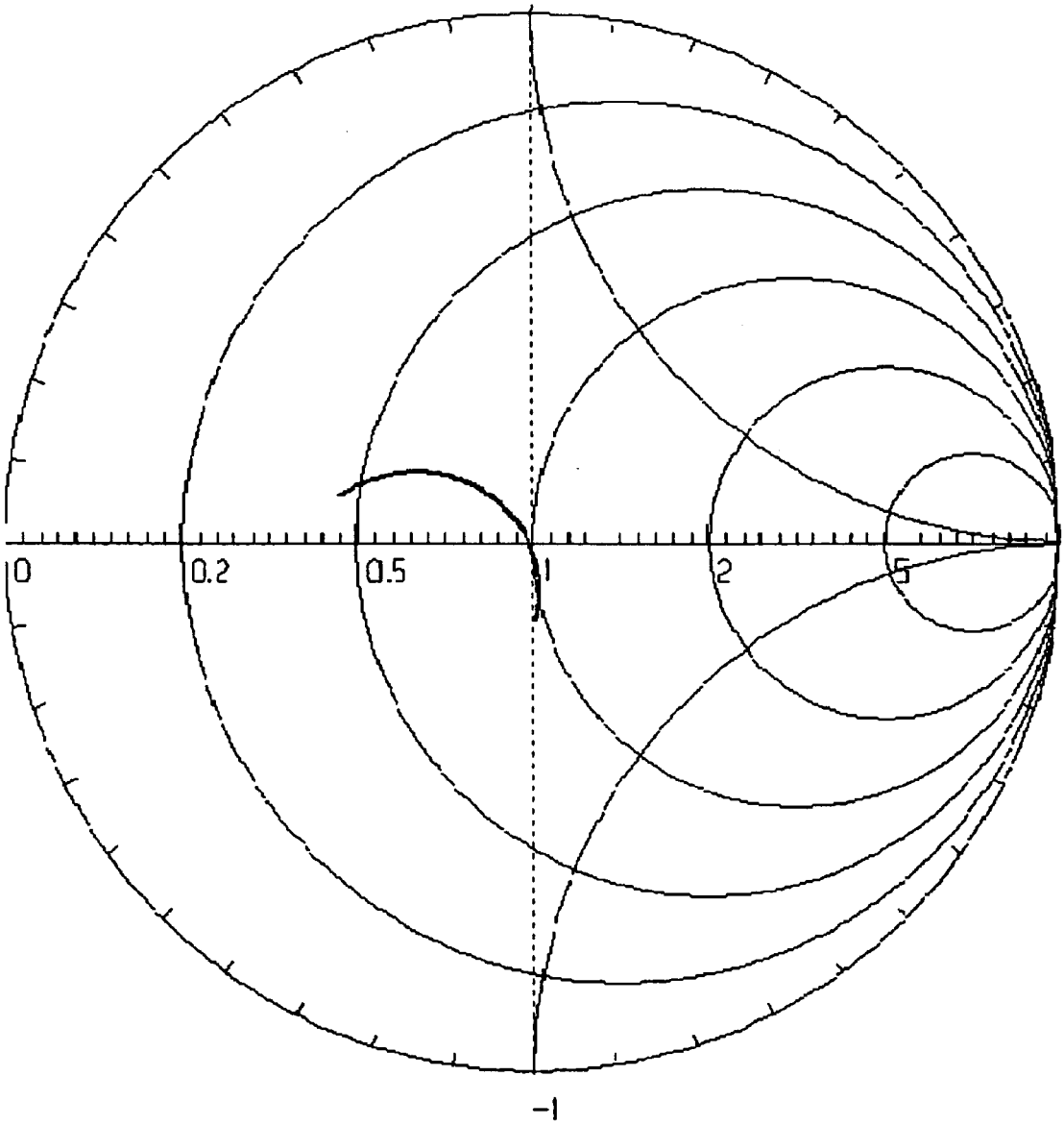
FIG. 10 shows a graph which plots the variation of input impedance due to frequency change of the antenna which utilizes metallic coating.

FIG. 10 shows a graph which plots the variation of input impedance due to frequency change of the antenna which utilizes metallic coating.

As shown in FIG. 5, the manufacturing steps of the antenna which utilizes metallic coating according to the present invention comprises: a molding step S1 for molding the lower layer conductive panel 130, mid layer conductive panel 120 and upper layer conductive panel 110 after pouring synthetic resin into a molding fixture; a checking step S2 for checking the molding for any deformation, incomplete part and addition of foreign substances on the external body of the lower layer conductive panel 130, mid layer conductive panel 120 and upper layer conductive panel 110; a checking step S3 for checking the material analysis and chemical composition of the lower layer conductive panel 130, mid layer conductive panel 120 and upper layer conductive panel 110 after finishing the previous step; a drying step S4 for completely drying the lower layer conductive panel 130, mid layer conductive panel 120 and upper layer conductive panel 110 by putting them in a drier for a fixed amount of time; an etching step S5 (chemicals used: CrO3, $H_2SO_4$, $Cr^{+3}$) for etching the surface in order to improve the degree of crystallization of the lower layer conductive panel 130, mid layer conductive panel 120 and upper layer conductive panel 110 after an annealing process (chemical composition CP front face body $H_2SO_4$); a cleaning and drying step S6 for cleaning and drying while keeping uniformly etched face of the lower layer conductive panel 130, mid layer conductive panel 120 and upper layer conductive panel 110; a deposition step S7 for depositing (Cu, $H_2SO_4$, $CuSO_4$, $5H_2O$, $H_3BO_3$, SB-75, SB-70M, $NISO_4$, EX, $6H_2O$, G1, G2, Chrome) using a electrical coating after an initial coating with the chemicals (Ni(YS100A, YS101B, YS102C)) in order to be able to receive the frequency on the surface of the lower layer conductive panel 130, mid layer conductive panel 120 and upper layer conductive panel 110 using a non-electrolyte coating; a drying step S8 for drying the lower layer conductive panel 130, mid layer conductive panel 120 and upper layer conductive panel 110 in a dryer for a fixed amount of time after a metallic substance has been deposited.

Also, the deposition step S7 according to the present invention utilizes a non-electrolyte coating of a metallic substance on the face of the lower layer conductive panel 130, mid layer conductive panel 120 and upper layer conductive panel 110 or utilizes a spray gun.

The effects of the antenna that utilizes a metallic coating and manufacturing method thereof according to the present invention are as follows.

First of all, the metal molding for the lower layer conductive panel 130, mid layer conductive panel 120 and upper layer conductive panel 110 are produced and synthetic resin is poured into the metal molding and finally the lower layer conductive panel 130, mid layer conductive panel 120 and upper layer conductive panel 110 are formed.

The molding of the lower layer conductive panel 130, mid layer conductive panel 120 and upper layer conductive panel 110 are checked first. The external body of the lower layer conductive panel 130, mid layer conductive panel 120 and upper layer conductive panel 110 are checked for any deformation, incomplete part and addition of foreign substances. A checking of material analysis and chemical composition of the lower layer conductive panel 130, mid layer conductive panel 120 and upper layer conductive panel 110 is carried out using a dedicated jig.

After checking of material analysis and chemical composition using a dedicated jig, the lower layer conductive panel 130, mid layer conductive panel 120 and upper layer conductive panel 110 are cleaned using cleaning Chlorine and dried. After the drying, a annealing process is carried out in order to increase the degree of crystallization of lower layer conductive panel 130, mid layer conductive panel 120 and upper layer conductive panel 110 and an etching is carried out in order to result a uniform surface.

After the etching, the lower layer conductive panel 130, mid layer conductive panel 120 and upper layer conductive panel 110 are cleaned and dried again. A thin metallic coating (Cu, $H_2SO_4$, $CuSO_4$, $5H_2O$, $H_3BO_3$, SB-75, SB-70M, $NISO_4$, EX, $6H_2O$, G1, G2, Chrome) is formed on the surface of the lower layer conductive panel 130, mid layer conductive panel 120 and upper layer conductive panel 110 using a non-electrolyte coating method.

After a metallic substance deposited on the surface of the lower layer conductive panel 130, mid layer conductive panel 120 and upper layer conductive panel 110 and dried for a fixed amount of time (6 min 10 sec–7 min 10 sec) at an appropriate temperature (35° C.–43° C.). Then quality of deposition on the lower layer conductive panel 130, mid layer conductive panel 120 and upper layer conductive panel 110 is checked and a surface checking for adherence strength is carried out. The adherence strength is checked using a separate jig and the surface is checked by a microscope.

Table 1 represents the measurements of antenna gains for a metal waveguide slot antenna and the antenna according to the present invention. As the measurements in Table 1 show, the gain value at each GHz band show a better result than the existing antenna made of a metallic substance.

TABLE 1

| Satellite communication frequency (GHz) | Gain of metal antenna (dBi) | Gain of antenna according to present invention (dBi) |
|---|---|---|
| 10.70 | 31.12 | 31.15 |
| 11.70 | 31.48 | 31.51 |
| 12.27 | 31.50 | 31.52 |
| 12.75 | 31.56 | 31.57 |

The reception gain at 10.7 GHz for the metallic waveguide slot antenna is 31.12 [dBi] whereas the reception gain for the antenna according to the present invention is 31.15 [dBi]. The corresponding radiation pattern is shown in FIG. 6. The reception gain at 11.7 GHz for the antenna according to the present invention is 31.51 [dBi] and the corresponding radiation pattern is shown in FIG. 7.

As shown in Table 1, the reception gain at 12.27 GHz for the antenna according to the present invention is 31.52 [dBi] and the corresponding radiation pattern is shown in FIG. 8.

The reception gain at 12.57 GHz for the antenna according to the present invention is 31.57 [dBi] and the corresponding radiation pattern is shown in FIG. 9.

As shown in Table 1, the antenna gain difference between the metallic waveguide slot antenna and the antenna according to the present invention show that the latter has a slightly higher value.

As explained so far, the antenna according to the present invention can be used for the purpose of communication or broadcasting depending on the design method. Also the performance is comparable or better than a metallic waveguide slot antenna.

With respect to the manufacturing precision for an ultra high frequency antenna 100, it can give a better precision in comparison to the case of working on a metal directly.

Also, it is suitable for mass manufacturing and the weight can be significantly reduced. As a result, an antenna fixing apparatus or an easy to handle antenna can be manufactured. For the metal coated synthetic resin antenna, there is no limit in the shape of the antenna (circular, rectangular, hexagonal, octagonal, polygonal)

The effect of the manufacturing method for the waveguide slot antenna according to the present invention, it can be utilized for a high power output antenna due to its small resistance and radiation loss. Also it can obtain a high gain value due to its small dielectric loss.

Also, the antenna can be manufactured by an assembly type of conducting panels, hence, its manufacturing is simple and miniaturization is easily achievable. It can easily be installed and portable resulting in a significant saving for installment.

Since the antenna is made of synthetic resin, the degree of precision that can be achieved for manufacturing is superior.

Also, it employs a plastic injection molding using a metal molding, mass manufacturing of antenna is possible. As a result the manufacturing cost is significantly lower in comparison to the manufacturing of the conventional antenna.

What is claimed is:

1. A waveguide slot antenna, comprising:

a lower layer conductive panel which further comprising a feeder line of a fixed length and width with an open face for gathering frequency signals towards the center in order to output them, a first waveguide which is connected to said feeder line in order to act as a transmission line of the frequency signals, and a radiation waveguide which is connected to one side of said first waveguide for receiving the frequency signals;

a mid layer conductive panel which is piled on the upper section of said lower layer conductive panel and has radiation holes which penetrate from the upper part to lower part at fixed intervals, and further comprising a second wave guide and a second feeder line where said radiation holes and said lower layer conductive panel are connected at the lower face; and an upper layer conductive panel which are piled on the upper section of said mid layer conductive panel and has protrusions at fixed intervals, a plurality of slots located at one side of said protrusion and penetrate from the upper to lower section, and a plurality of guides in the shape a cavity at fixed intervals on the lower face.

2. The antenna as claimed in claim 1, wherein said upper, mid and lower layer conductive panels of the waveguide are made of synthetic resin and are thinly coated with Ni, Cu, $H_2SO_4$, EX, $5H_2O$, $H_3BO_3$, $NISO_4$, $6H_2O$.

3. The antenna as claimed in claim 1, wherein said upper, mid and lower layer conductive panels are made of a metal substance.

4. The antenna as claimed in claim 1, wherein at one side of radiation waveguide of said lower layer conductive panel of the waveguide further comprising multi-layer protrusions in order to transfer frequency signals from the radiation hole of said mid layer conductive panel to the first waveguide and second waveguide without a loss.

5. The antenna as claimed in claim 1, wherein the plurality of slots on said upper layer conductive panel form 4 different groups and are focused into a guide in the shape of a cavity and said plurality of slots are piled onto each other in order to transfer the focused frequency signals to the radiation waveguide of said upper layer conductive panel via the radiation hole of said mid layer conductive panel.

6. The antenna as claimed in claim 1, wherein said mid layer conductive panels of the waveguide is formed so that the plurality of radiation holes, and the second waveguide and second feeder line are connected to each other in order to allow an active frequency signal reception.

7. The antenna as claimed in claim 1, wherein the upper face of said low layer conductive panel of the waveguide, the feeder line that outputs the focused satellite frequency signals, the first waveguide which acts as a transmission line in connection with said feeder line, and the radiation waveguide that receives the frequency in connection with said first waveguide are thinly coated with metallic substance.

8. The antenna as claimed in claim 1, wherein the upper face of said low layer conductive panels of the waveguide, a plurality of radiation holes are formed at said upper face, and the second waveguide and second feeder line are thinly coated with a metallic substance in order to receive the satellite frequency.

9. The antenna as in any one of claim 1, 2 or 3, wherein at one side of radiation waveguide of the upper layer conductive panel of the waveguide further comprising multi-layer protrusions in order to transfer the frequency signals from the radiation hole of said mid layer conductive panel to the first waveguide and second waveguide without a loss.

10. The antenna as in any one of claim 1, 2 or 3, wherein the plurality of slots on said upper layer conductive panel form 4 different groups and are focused to a guide in the shape of a cavity and said plurality of slots are piled onto each other in order to transfer the focused frequency signals to the radiation waveguide of said upper layer conductive panel via the radiation hole of mid layer conductive panel.

11. The antenna as in any one of claim 1, 2 or 3, wherein said mid layer conductive panel of the waveguide is formed so that the plurality of radiation holes, and the second waveguide and the second feeder line are connected to each other in order to allow an active frequency signal reception.

12. The antenna as in any one of claim 1 or 5, wherein the guide in the shape of a cavity of said upper layer conductive panel and the radiation waveguide of said lower layer conductive panel are connected in order to allow an active frequency signal reception.

13. The antenna as in any one of claim 1 or 5, wherein the second waveguide formed at said mid layer conductive panel, the second feeder line, the first waveguide formed at the lower layer conductive panel, radiation waveguide and the multi-layer protrusion are symmetrically formed.

14. The antenna as in any one of claim 1 or 6, wherein at on the one side of the mid layer conductive panel has a hooking jaw in order to pile onto the upper section of said lower layer conductive panel.

15. A manufacturing method of a waveguide slot antenna, comprising the steps of:

a molding step for molding the body of an antenna by pouring synthetic resin into a molding fixture;

a molding checking step for checking the molding for any deformation, incomplete part and addition of foreign substances on the external body of the antenna;

a match checking step for checking the matching for analyzing the materials and chemical composition for the antenna body;

a first drying step for drying the antenna body by putting the antenna in a drier for a fixed amount of time;

an etching step for etching the surface of the antenna in order to improve the degree of crystallization of the dry hardened antenna;

a second drying step for drying the surface of the etched antenna after a cleaning step;

a deposition step for depositing (Cu, $H_2SO_4$, $CuSO_4$, $5H_2O$, $H_3BO_3$, SB-75, SB-70M, $NISO_4$, EX, $6H_2O$, G1, G2, Chrome) using a electrical coating after an initial coating with the chemicals (Ni(YS100A, YS101B, YS102C)) in order to be able to receive the frequency on the surface of the antenna body using a non-electrolyte coating; and a third drying step for drying the body of the antenna in a dryer after a metallic substance has been deposited.

16. The method as claimed in claim 15, wherein said deposition step further including a step of adding a metal substance (Fe) which acts as a catalyst in the coating liquid deposited on the body of the antenna.

17. The method as claimed in claim 15, wherein said deposition step further including a step of depositing a coating layer on the plurality of radiation holes, the second waveguide and the second feeder line in order to allow an active frequency signals reception by said mid layer conductive panel.

18. The method as claimed in claim 15, wherein said deposition step further including a step of depositing a coating layer on the guides in the shape a cavity on the upper layer conductive panel and the radiation holes on the mid layer conductive panel in order to act as connection line for frequency signals.

19. The method as claimed in claim 15, wherein said step of checking the surface adherence of the waveguide slot antenna using a microscope and fixing jig after finishing said third drying step.

20. The method as claimed in claim 15, wherein said metal thin coating of the antenna body utilizing a non-electrolyte coating of a metallic substance.

21. The method as claimed in claim 15, wherein said the deposition of metallic conductive substance on the antenna body utilizing a spray gun.

22. The method as claimed in claim 15, wherein said coating liquid deposited on the antenna body further including metallic substances such as Fe, Ni, and P.

* * * * *